US009654873B2

(12) United States Patent
Akino

(10) Patent No.: US 9,654,873 B2
(45) Date of Patent: May 16, 2017

(54) MICROPHONE DEVICE

(71) Applicant: Hiroshi Akino, Tokyo (JP)

(72) Inventor: Hiroshi Akino, Tokyo (JP)

(73) Assignee: KABUSHIKI KAISHA AUTO TECHNICA, Tokyo (JP)

( * ) Notice: Subject to any disclaimer, the term of this patent is extended or adjusted under 35 U.S.C. 154(b) by 0 days.

(21) Appl. No.: 15/017,706

(22) Filed: Feb. 8, 2016

(65) Prior Publication Data

US 2016/0234597 A1 Aug. 11, 2016

(30) Foreign Application Priority Data

Feb. 10, 2015 (JP) ..... 2015-023735

(51) Int. Cl.

| | |
|---|---|
| ***H04R 29/00*** | (2006.01) |
| ***H04R 9/08*** | (2006.01) |
| ***H04R 11/04*** | (2006.01) |
| ***H04R 19/04*** | (2006.01) |
| ***H04R 17/02*** | (2006.01) |
| ***H04R 21/02*** | (2006.01) |
| ***H04R 3/00*** | (2006.01) |
| *H04R 1/04* | (2006.01) |

(52) U.S. Cl.

CPC ..... *H04R 3/007* (2013.01); *H04R 1/04* (2013.01); *H04R 19/04* (2013.01); *H04R 2410/03* (2013.01)

(58) Field of Classification Search

CPC ..... H04R 3/007; H04R 1/04; H04R 2410/03; H04R 3/00

USPC ... 381/58, 174, 355, 191, 113, 111, 361, 59, 381/56

See application file for complete search history.

(56) References Cited

U.S. PATENT DOCUMENTS

2008/0317262 A1* 12/2008 Schlichting ..... H04R 3/06 381/113
2011/0280418 A1* 11/2011 Matsunaga ..... H04R 19/016 381/174

FOREIGN PATENT DOCUMENTS

JP 4533784 B2 9/2010
JP 4683996 B2 5/2011

* cited by examiner

*Primary Examiner* — Thjuan K Addy
(74) *Attorney, Agent, or Firm* — Whitham, Curtis & Cook

(57) ABSTRACT

The present invention provides a microphone device capable of preventing a breakdown of a signal processor, which is provided in a circuit case, processing signals from a microphone unit accommodated in a unit case, and preventing production of noise in a state the unit case is detached from the circuit case. A microphone device 1 includes a unit case 3 accommodating a microphone unit 31, a circuit case 4 accommodating an input terminal receiving signals from the microphone unit, and a signal processor processing the signals input to the input terminal, the unit case 3 being detachably fixed to the circuit case 4, and a detector (38, 44) detecting the attachment or detachment between the unit case and the circuit case. The detector grounds the input terminal in response to the detection of the detachment of the unit case from the circuit case.

7 Claims, 8 Drawing Sheets

MICROPHONE DEVICE

TECHNICAL FIELD

The present invention relates to microphone devices including replaceable microphone units.

BACKGROUND ART

Some conventional condenser microphone are of a stick type including replaceable microphone units of different directivity characteristics (see, for example, Japanese Patent Nos. 4533784, and 4683996). Such a microphone device is provided with, for example, cardioid, hyper cardioid, non-directional, and bidirectional microphone units, from which a user selects one suitable for the purpose and mounts the selected one to a microphone body having a built-in power module.

The microphone device including replaceable microphone units includes a unit case for accommodating one of the microphone units, a circuit case accommodating a signal processor for processing an audio signal output from the microphone unit, a cap for covering an opening of the unit case, and a rear case accommodating a connector for outputting signals generated by the signal processor to an external device.

FIG. 7 is a cross-sectional front view illustrating components accommodated in a unit case of a conventional microphone device. FIG. 7 illustrates a cap 2 is fixed on a unit case 3. Now, an example of the microphone device to which a unidirectional microphone unit is mounted is described.

A microphone unit 31 is accommodated in the front side (upper side in the drawing) in the unit case 3. An inner plate 34 is fitted and fixed in the rear side (lower side in the drawing) in the unit case 3. An outer plate 35 is fitted and fixed to the rear side of the inner plate 34, in the unit case 3. A first terminal 37, which is a conductive terminal having a rim, is inserted into a hole formed on the center of the outer plate 35 from the inside (front side) toward the outside (rear side) of the unit case 3. A rod shaped terminal 33 is inserted into a hole formed on the center of the inner plate 34 from the outside toward the inside. The terminal 33 is fixed to the inner plate 34 so as to project toward the microphone unit 31. A conductive spring 36 is disposed in the central holes of the inner plate 34 and the outer plate 35. The first terminal 37 has a semispherical shaped rear end. The first terminal 37 is accommodated in the unit case 3 and protrudes outwardly from the outer plate 35 by the urging force of the spring 36. Thus, the rear end of the first terminal 37 is projecting outwardly from the outer plate 35. An output terminal plate 32 extending from the microphone unit 31 is screwed to the front end of the terminal 33.

FIG. 8 is a cross-sectional front view illustrating components accommodated in the circuit case and components accommodated in the rear case attached to the circuit case of the conventional microphone device. A front end plate 41 is fitted and fixed in the inner circumference of the circuit case 4 at the top adjacent to an internal thread 4S and on the rear of the internal thread 4S. A conductive second terminal 42 penetrates the center of the front end plate 41 across the thickness (longitudinal direction in the drawing) and is fitted and fixed to the front end plate 41.

A circuit board 43 is disposed in the circuit case 4 and along the length direction of the circuit case 4. The circuit board 43 constitutes a signal processor that processes signals from the microphone unit 31. The second terminal 42 is connected to an input terminal of the circuit board 43 with an appropriate conductive material provided therebetween.

A rear case 5 is fitted to the rear end of the circuit case 4, and the circuit case 4 and the rear case 5 are fastened with a screw 6. The rear end of the circuit board 43 is received in a deep groove 51 in the rear case 5. The circuit board 43 is electrically connected to the rear case 5.

In the rear case 5, an insulation connector base 52 is fitted and fastened, for example, with a screw. The connector base 52 is provided with a connector having three standardized conductive pins. The connector is embedded in the connector base 52. A first pin 53 is connected to a ground terminal of the circuit board 43. A second pin 54 is connected to an output terminal at a hot side of an output circuit of the circuit board 43. A third pin (not illustrated) is connected to an output terminal at a cold side of the output circuit of the circuit board 43. The rear case 5 has a groove 55 for positioning in the rotating-direction on the connector base 52.

A connector plug (not illustrated) is inserted into the rear case 5. Audio signals from the microphone unit 31 are output to an external device via the second pin 54, the third pin, and a microphone code connected to a connector plug.

FIG. 9 is a cross-sectional front view illustrating the conventional microphone device. An external thread 3S of the unit case 3 is screwed into the internal thread 4S of the circuit case 4. As a result, the spring 36 is compressed. The unit case 3 is connected (attached) to the circuit case 4. After the unit case 3 and the circuit case 4 are attached to each other, the first terminal 37 of the unit case 3 is pressed by a compressive force of spring 36. The first terminal 37 of the unit case 3 comes in contact with the second terminal 42 of the circuit case 4. As a result, the first terminal 37 of the unit case 3 is electrically connected with the second terminal 42 of the circuit case 4.

Audio signals from the microphone unit 31 are sent to an input terminal of the circuit board 43 via the output terminal plate 32, the terminal 33, the spring 36, the first terminal 37, and the second terminal 42. The circuit board 43 performs predetermined processes such as impedance transformation of the audio signals received from the microphone unit 31, low-cut processing, and amplification to generate output signals. The output signals generated in the circuit board 43 are transmitted to the first pin 53, the second pin, 54, and the third pin.

An impedance of a signal source is a capacitance (of approximately several pF to several tens of pF). Thus, the condenser microphone requires an impedance transducer having a field-effect transistor (FET). The FET includes a gate electrode, a drain electrode, and a source electrode. The signals from the microphone unit are sent to the gate electrode. The FET may break if high-voltage electric current flows into the gate electrode. To avoid such an FET breakdown, a protective diode is connected to an input for the signals from the microphone unit.

Unfortunately, the method of connecting the protective diode to prevent the FET breakdown may increase the stray capacitance of the input due to the electrostatic capacitance of the diode, and thus decrease the sensitivity of the microphone device.

An electrostatic shield is formed by the unit case 3 and the circuit case 4 after the unit case 3 and the circuit case 4 are attached to each other. This prevents the gate electrode from being affected by high voltage. In contrast, the electrostatic shield is not formed after the unit case 3 and the circuit case 4 are detached for replacement of the microphone unit. In such a state, if a charged human body touches a component provided for the connection with the unit case 3 accommodated in the circuit case 4, for example, the second terminal 42, the electric charge of the human body flows into the gate electrode via the connection component, and this breaks the FET.

In another case, if the unit case 3 and the circuit case 4 are detached during the electrical operation of the components in the circuit case 4, the microphone device produces loud noise due to disconnection between the contact points of the unit case 3 and the circuit case 4.

As described above, the gate electrode is electrically disconnected from the connected components if the unit case 3 and the circuit case 4 are detached. The FET breakdown or the noise production can be prevented, however, by grounding the connection component if the unit case 3 and the circuit case 4 are detached.

SUMMARY OF INVENTION

Technical Problem

An object of the present invention, which has been made to solve the problem described above, is to provide a microphone device capable of preventing a breakdown of a signal processor provided in a circuit case processing signals from a microphone unit accommodated in a unit case, and production of noise in a state the unit case and the circuit case are detached.

A microphone device according to the present invention includes a unit case accommodating a microphone unit; a circuit case accommodating an input terminal receiving signals from the microphone unit, and a signal processor processing the signals input to the input terminal, the unit case being detachably fixed to the circuit case, and a detector detecting the attachment or detachment between the unit case and the circuit case. The detector grounds the input terminal in response to the detection of the detachment between the unit case and the circuit case.

According to an aspect of the present invention, a breakdown of the components in the circuit case and production of noise can be prevented.

DESCRIPTION OF EMBODIMENTS

Embodiments of a microphone device according to the present invention will now be described with reference to the present invention.

Figure 1:
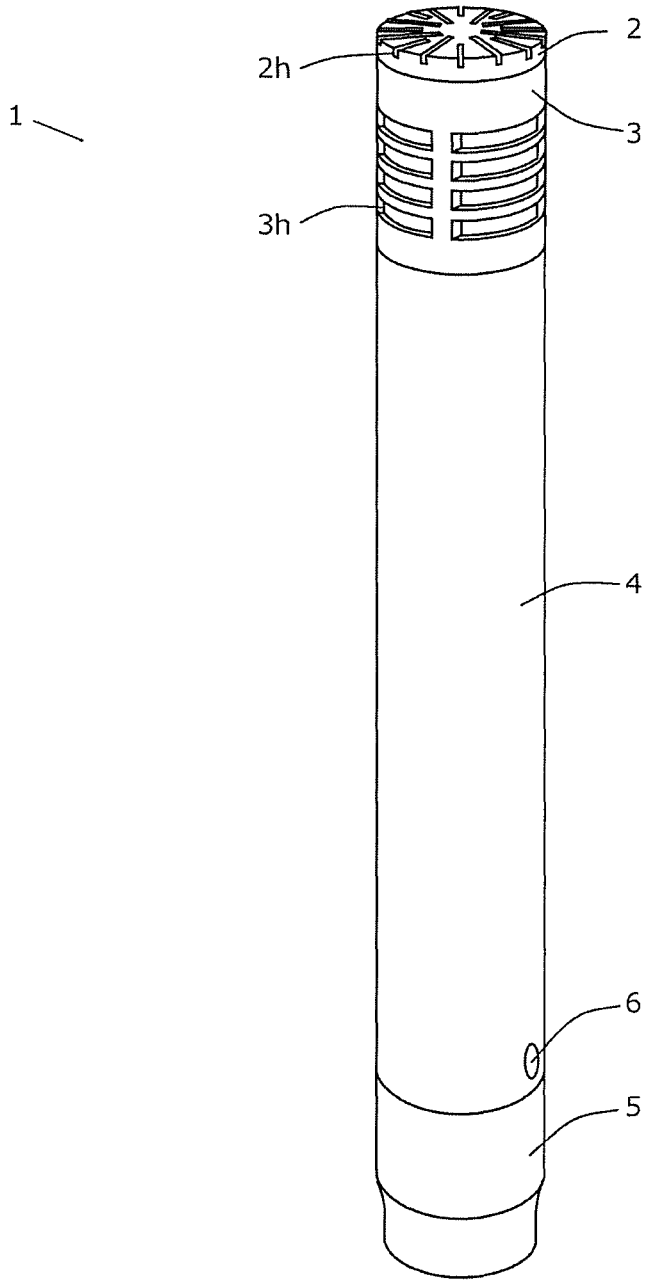
FIG. 1 is an external view illustrating a microphone device according to an embodiment of the present invention.

FIG. 1 is an external view illustrating a microphone device according to an embodiment of the present invention. A microphone device 1 includes a cap 2, a unit case 3, a circuit case 4, and a rear case 5.

The microphone device of the embodiment of the invention can replace microphone units, and includes a unidirectional microphone unit as an example in the description below.

The cap 2 is made of metal and is in a bottomed cylindrical shape. The cap 2 has sound holes 2*h* as a front acoustic terminal, on the front side (the direction of the microphone device 1 directed to a sound source during sound collection) of the cap 2. The cap 2 is fixed to cover a front opening of the cylindrical shaped unit case 3.

The unit case 3 is made of metal and is in a cylindrical shape, and the unit case 3 has sound holes 3*h* as a rear acoustic terminal, on the side surface of the unit case 3.

The acoustic terminal corresponds to the central point of the air moving simultaneously with a diaphragm provided in the microphone unit, to be exact. The unidirectional microphone unit has the acoustic terminals at the front and at the rear of the diaphragm. As described above, the acoustic terminals represent spacial points, and the acoustic terminals are referred to as the sound holes 2*h* and 3*h*, which are elements corresponding to these points in the microphone device 1.

The circuit case 4 is made of metal and is in a cylindrical shape. The unit case 3 is attached to the front of the circuit case 4. The rear case 5 is attached to the rear of the circuit case 4. The circuit case 4 serves as a grip of the microphone device 1. A screw 6 is a stopper that fixes the circuit case 4 and the rear case 5 together.

The rear case 5 is made of metal. The rear case 5 having a large diameter segment and a small diameter segment. The large diameter segment and the small diameter segment have substantially cylindrical hollow shapes respectively, and these hollows communicate with each other.

Figure 2:
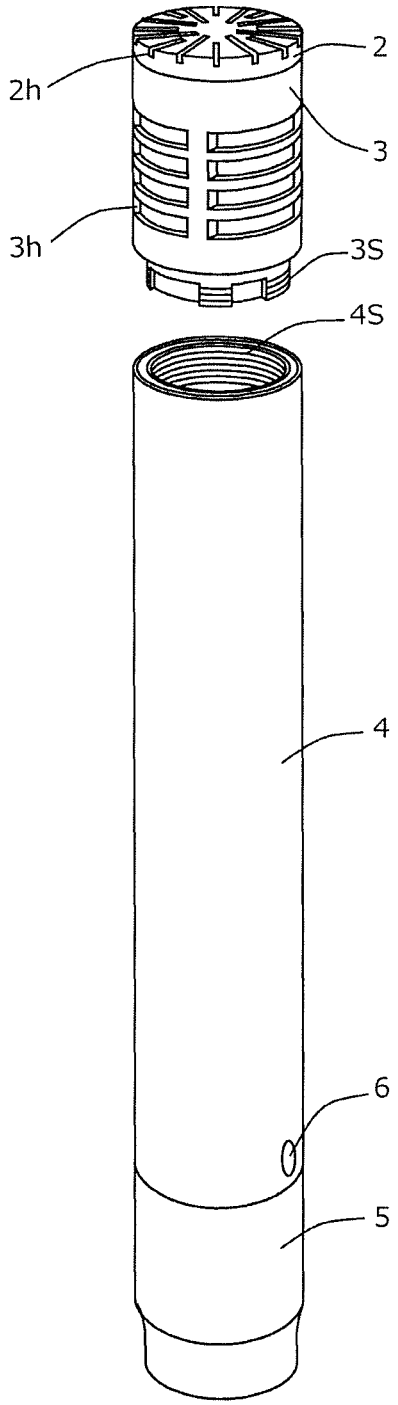
FIG. 2 is an external view illustrating the microphone device from which a unit case of the microphone device and a circuit case of the microphone device are detached.

FIG. 2 is an external view illustrating the microphone device 1 from which the unit case 3 and the circuit case 4 are detached. The unit case 3 has an external thread 3S on its rear end. The circuit case 4 has an internal thread 4S on the inner wall at its front end. The external thread 3S is screwed into the internal thread 4S, thus the unit case 3 and the circuit case 4 are fastened.

Figure 3:
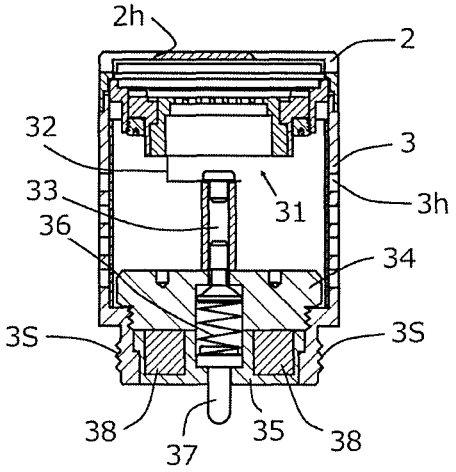
FIG. 3 is a cross-sectional front view illustrating the unit case and its components.

FIG. 3 is a cross-sectional front view illustrating the unit case 3 and its components. FIG. 3 illustrates the cap 2 is fixed on the unit case 3. The unit case 3 accommodates a microphone unit 31 in the front (upper side in the drawing) in the unit case 3. The microphone unit 31 includes a diaphragm and a fixed electrode constituting a condenser, and a disk shaped circuit board converting changes in capacitance between the diaphragm and the fixed electrode into electrical signals and outputting the signals, in the metal bottomed cylindrical shaped unit case 3. The capacitance of the condenser varies depending on the vibration of the diaphragm caused by sound waves from the sound holes 2*h*.

An inner plate 34 is fitted and fixed in the rear side (lower side in the drawing) in the unit case 3. An outer plate 35 is fitted and fixed to the rear side of the inner plate 34, in the unit case 3. A first terminal 37, which is a conductive terminal having a rim, is inserted into a hole formed on the center of the outer plate 35 from the inside (front side) toward the outside (rear side) of the unit case 3. A rod shaped terminal 33 is inserted into a hole formed on the center of the inner plate 34 from the outside toward the inside. The terminal 33 is fixed to the inner plate 34 so as to project toward the microphone unit 31. A conductive spring 36 is disposed in the central holes of the inner plate 34 and the outer plate 35. The first terminal 37 has a semispherical shaped rear end. The first terminal 37 is accommodated in the unit case 3 and protrudes outwardly from the outer plate 35 by the urging force of the spring 36. Thus, the rear end of the first terminal 37 is projecting outwardly from the outer plate 35. An output terminal plate 32 extending from the microphone unit 31 is screwed to the front end of the terminal 33.

A ring shaped magnet 38 is embedded in the outer plate 35. The usage of the magnet 38 will be described below.

Figure 4:
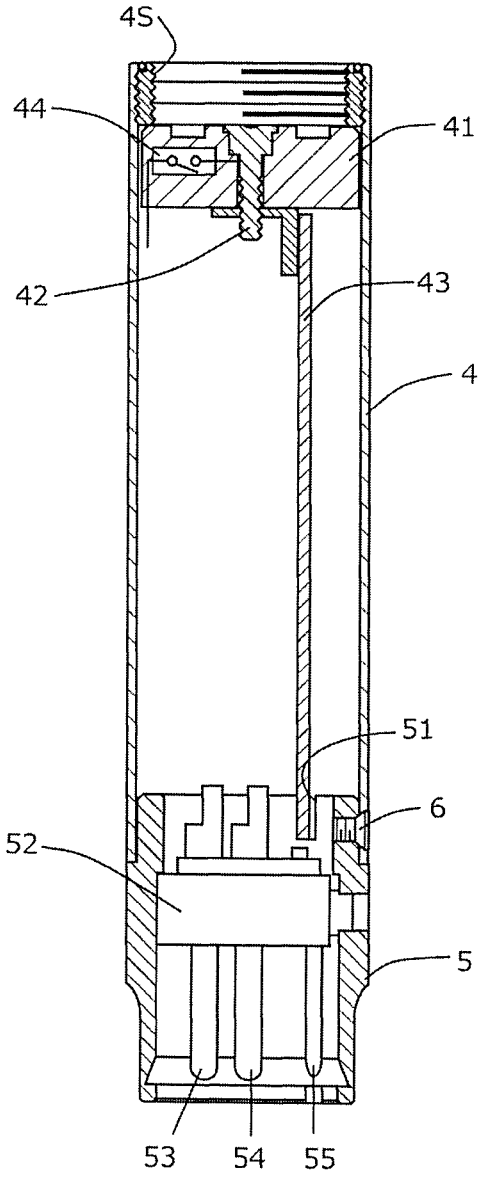
FIG. 4 is a cross-sectional front view illustrating components in the circuit case and components in a rear case attached to the circuit case.

FIG. 4 is a cross-sectional front view illustrating components in the circuit case 4 and components in the rear case 5. A front end plate 41 is fitted and fixed in the inner circumference of the circuit case 4 at the top adjacent to the internal thread 4S and on the rear of the internal thread 4S. A conductive second terminal 42 is penetrates the center of the front end plate 41 across the thickness (longitudinal direction in the drawing) and is fitted and fixed to the front end plate 41.

A circuit board 43 is disposed in the circuit case 4 and along the length direction of the circuit case 4. The circuit board 43 constitutes a signal processor that processes signals from the microphone unit 31. The circuit board 43 integrates an impedance transducer including an FET, and various circuits, such as an output circuit. The second terminal 42 is connected to an input terminal of the circuit board 43 with an appropriate conductive material provided therebetween.

A switch 44 is disposed in the front end plate 41 in the circuit case 4. The operations of the switch 44 will be described below.

The rear case 5 is fitted to the rear end of the circuit case 4, and the circuit case 4 and the rear case 5 are fastened with a screw 6. The rear end of the circuit board 43 is received in a deep groove 51 in the rear case 5. The circuit board 43 is electrically connected to the rear case 5.

The circuit board 43 and the rear case 5 may be electrically connected by inserting one end of a leaf spring (not illustrated) between the rear end of the circuit board 43 and the deep groove 51, and mounting the other end of the leaf spring to the rear case 5.

An insulation connector base 52 is fitted and fastened, for example, with a screw, in the rear case 5. The connector base 52 is provided with a connector having three standardized conductive pins. The connector is embedded in the connector base 52. The connector is, for example, an output connector conforming to the JEITA standard RC-5236 "Circular Connectors, Latch Lock Type For Audio Equipment", the output connector having a first ground pin 53, a second pin 54 at a hot (HOT) side of a signal, and a third pin (not illustrated) at a cold (COLD) side. The first pin 53 is connected to a ground terminal of the circuit board 43. The second pin 54 is connected to an output terminal at the hot side of an output circuit of the circuit board 43. The third pin is connected to an output terminal at the cold side of the output circuit of the circuit board 43. The rear case 5 has a groove 55 for positioning in the rotating-direction on the connector base 52.

A connector plug (not illustrated) is inserted into the rear case 5. Audio signals from the microphone unit 31 are output to an external device via the second pin 54, the third pin, and a microphone code connected to a connector plug.

Figure 5:
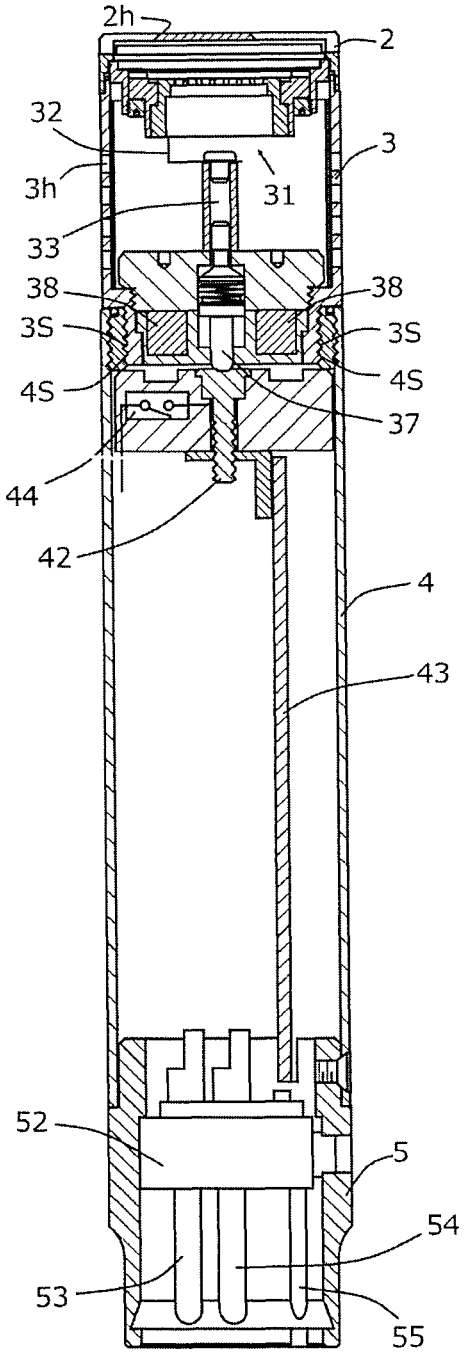
FIG. 5 is a cross-sectional front view illustrating the microphone device.

FIG. 5 is a cross-sectional front view illustrating the microphone device 1. The external thread 3S of the unit case 3 is screwed into the internal thread 4S of the circuit case 4. This operation compresses the spring 36, and connects (attaches) the unit case 3 to the circuit case 4. After the unit case 3 and the circuit case 4 are attached to each other, the first terminal 37 of the unit case 3 is pressed by a compressive force of the spring 36. The first terminal 37 of the unit case 3 comes in contact with the second terminal 42 of the circuit case 4. As a result, the first terminal 37 of the unit case 3 is electrically connected with the second terminal 42 of the circuit case 4.

Audio signals from the microphone unit 31 are inputted to an input terminal of the circuit board 43 via the output terminal plate 32, the terminal 33, the spring 36, the first terminal 37, and the second terminal 42. The circuit board 43 performs predetermined processes such as impedance transformation of the audio signals input from the microphone unit 31, low-cut processing, and amplification to generate output signals. The output signals generated in the circuit board 43 are transmitted to the first pin 53, the second pin, 54, and the third pin.

Figure 6:
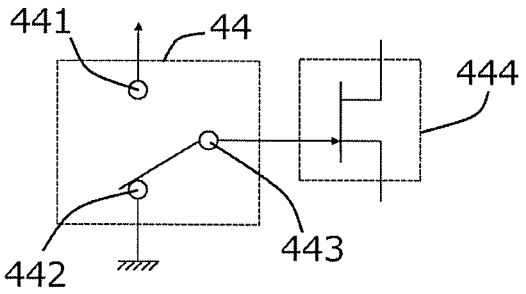
FIG. 6 illustrates a structure of connection of a switch accommodated in the circuit case.
Figure 7:
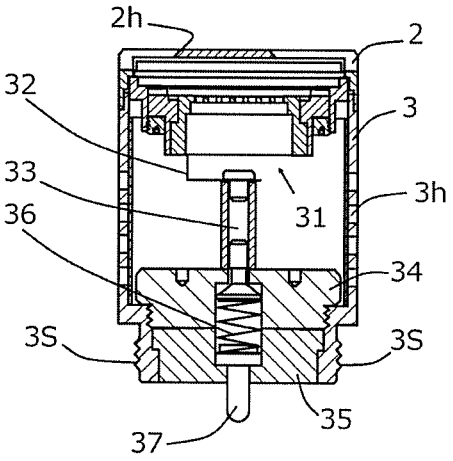
RELATED ART FIG. 7
FIG. 7 is a cross-sectional front view illustrating components accommodated in a unit case of a conventional microphone device.
Figure 8:
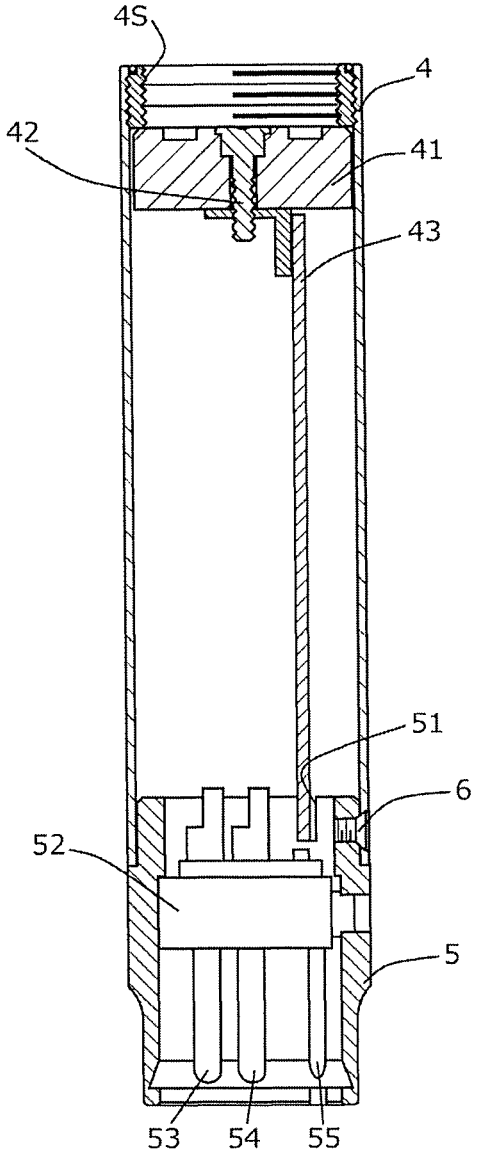
RELATED ART FIG. 8
FIG. 8 is a cross-sectional front view illustrating components accommodated in a circuit case and components accommodated in a rear case attached to the circuit case of the conventional microphone device.
Figure 9:
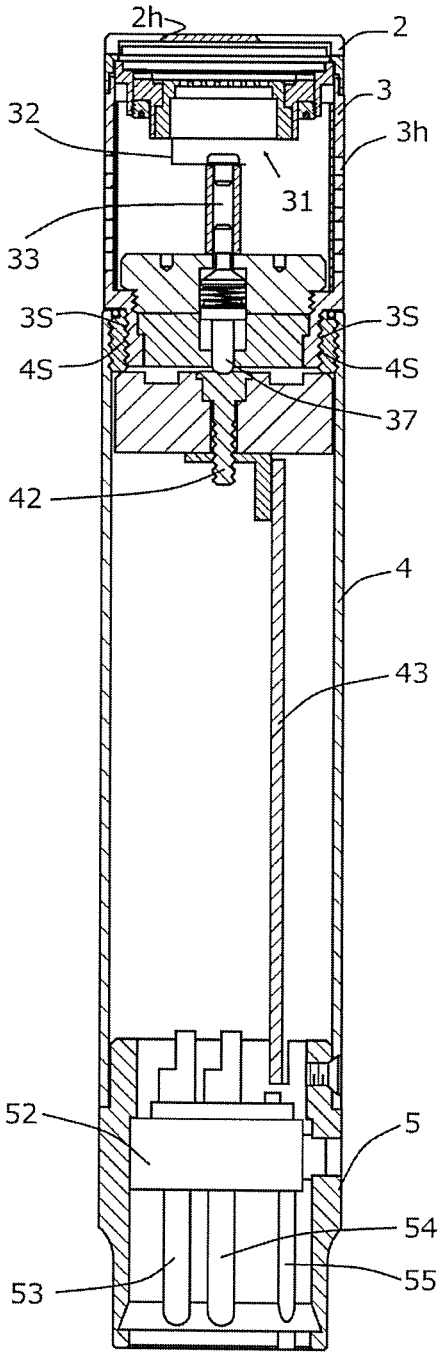
RELATED ART FIG. 9
FIG. 9 is a cross-sectional front view illustrating the conventional microphone device.

FIG. 6 illustrates a structure of connection of a switch 44 accommodated in the circuit case 4. The switch 44 includes a first fixed contact 441 connected to the second terminal 42, a second fixed contact 442 connected to the ground (ground circuit), and a movable contact 443 connected to an input terminal of the circuit board 43. The input terminal of the circuit board 43 connected to the movable contact 443 is, for example, a gate electrode of an FET 444 integrated in the circuit board 43.

The switch 44 is a transfer-type reed switch that operates in response to application of a magnetic field from the outside to switch the contacts. The first fixed contact 441, which is a so-called normally open contact, is a closed (ON) state while a magnetic field is being applied. The second fixed contact 442, which is a so-called normally closed contact, is an open (OFF) state while the magnetic field is being applied. The movable contact 443, which is a so-called common contact, comes in contact with the first fixed contact 441 or the second fixed contact 442. The movable contact 443 is connected to the second fixed contact 442 during the steady state of the switch 44.

The magnet 38 in the unit case 3 applies the magnetic field to the switch 44. The direction of the magnetic field is the long distance direction of the unit case 3 and the circuit case 4 (vertical direction in FIG. 5).

In a state where the unit case 3 and the circuit case 4 are attached to each other, that is, in a state the magnet 38 approaches the switch 44, the magnetic field generated by the magnet 38 is applied to the switch 44. The movable contact 443 then comes into contact with the first fixed contact 441 by this application. With this contact, the second terminal 42 is connected to the gate electrode of the FET 444, which is an input terminal of the circuit board 43. In other words, the audio signals from the microphone unit 31 can be input into the signal processor in the circuit board 43.

In contrast, in a state where the unit case 3 and the circuit case 4 are detached, that is, in a state the magnet 38 is separated from the switch 44, the magnetic field generated by the magnet 38 is not applied to the switch 44 or the magnetic field being applied to the switch 44 is released. The movable contact 443 then comes into contact with the second fixed contact 442. With this contact, the gate electrode of the FET 444, which is the input terminal of the circuit board 43, is grounded. In other words, for example, if an electrically charged human body touches the second terminal 42, no electric charge flows into the gate electrode of the FET 444 via the second terminal 42, and a breakdown of the FET can be prevented. The second fixed contact 442 is connected, for example, to a ground pattern on the circuit board 43. If the circuit case 4 is made of metal, the second fixed contact 442 is also connected to the circuit case 4.

As described above, the magnet 38 and the switch 44 are constitute a detector that determines whether the unit case 3 and the circuit case 4 are attached or detached. The magnet 38 serves as a switching unit that switches the connection between the first fixed contact 441 and the movable contact 443 and the connection between the second fixed contact 442 and the movable contact 443 provided in the switch 44, in a noncontact manner. That is, the magnet 38 switches the connection between the first fixed contact 441 and the movable contact 443 and the connection between the second fixed contact 442 and the movable contact 443, in a state not in physical contact with the switch 44.

According to the embodiment described above, the microphone device 1 grounds the input terminal of the circuit board 43 in response to the detection of the detachment of the unit case 3 from the circuit case 4. This prevents undesirable electric charge from flowing into the input terminal of the circuit board 43 via the second terminal 42, and prevents the components integrated on the circuit board 43 such as the FET from being broken.

Similarly, the microphone device 1 disconnects the first terminal 37 and the second terminal 42 upon the detachment of the unit case 3 from the circuit case 4. Simultaneously with the disconnection of the first terminal 37 and the second terminal 42, the microphone device 1 disconnects the second terminal 42 from the input terminal of the circuit board 43. This prevents undesirable signals from entering the circuit board 43, and production of noise.

The invention claimed is:

1. A microphone device comprising:

a unit case accommodating a microphone unit and a first terminal outputting the signals from the microphone unit;

a circuit case accommodating a second terminal to be connected to the first terminal, an input terminal receiving signals from the microphone unit, and a signal processor processing the signals input to the input terminal, wherein the unit case is detachably fixable to the circuit case; and a detector detecting attachment or detachment between the unit case and the circuit case, wherein the detector is separate and different from the first and second terminals, wherein the detector grounds the input terminal in response to detection of the detachment between the unit case and the circuit case.

2. The microphone device according to claim 1, wherein the signals from the microphone unit are inputted to the input terminal in response to the detection of the attachment between the unit case and the circuit case.

3. The microphone device according to claim 1, wherein the microphone unit is a condenser microphone unit, the signal processor includes a field-effect transistor (FET) for performing impedance transformation of the signals from the microphone unit; and the input terminal is a gate electrode of the FET.

4. The microphone device according to claim 1, wherein the detector includes a switch accommodated in the circuit case, and a switching unit accommodated in the unit case, the switch includes a movable contact, a first fixed contact, and a second fixed contact, wherein the movable contact is connected to the input terminal, the first fixed contact is connected to the second terminal, and the second fixed contact is grounded, and the switching unit switches the connection between the movable contact and the first fixed contact, and the connection between the movable contact and the second fixed contact.

5. The microphone device according to claim 4, wherein the switching unit switches (i) the connection between the movable contact and the first fixed contact, and (ii) the connection between the movable contact and the second fixed contact in a noncontact manner.

6. The microphone device according to claim 4, wherein the switching unit is a member generating a magnetic field, and the switch operates in response to the application of the magnetic field.

7. The microphone device according to claim 4, wherein the switch is a transfer-type switch, and the movable contact is connected to the second fixed contact during a steady state of the switch.

* * * * *